US011167971B2

(12) United States Patent
Abbit

(10) Patent No.: US 11,167,971 B2
(45) Date of Patent: Nov. 9, 2021

(54) FREESTANDING PRODUCT TRANSFER DEVICE

(71) Applicant: Steven Michael Abbit, Phoenix, AZ (US)

(72) Inventor: Steven Michael Abbit, Phoenix, AZ (US)

( * ) Notice: Subject to any disclaimer, the term of this patent is extended or adjusted under 35 U.S.C. 154(b) by 0 days.

(21) Appl. No.: 16/836,348

(22) Filed: Mar. 31, 2020

(65) Prior Publication Data

US 2020/0307980 A1 Oct. 1, 2020

Related U.S. Application Data

(60) Provisional application No. 62/827,592, filed on Apr. 1, 2019.

(51) Int. Cl.
*B67C 11/02* (2006.01)
*B01L 9/00* (2006.01)

(52) U.S. Cl.
CPC ..... *B67C 11/02* (2013.01); *B01L 9/00* (2013.01)

(58) Field of Classification Search
CPC ... B67C 11/00; B67C 11/02; B67C 2011/022; B01D 29/05
USPC ..... 141/319, 331–345; 248/83, 86, 94, 121, 248/125.3, 125.8, 188.5, 346.07, 346.5
See application file for complete search history.

(56) References Cited

U.S. PATENT DOCUMENTS 1,923,480 A 6/1877 Preston
483,664 A * 10/1892 Aborn ..... F16N 33/00 141/106
545,915 A * 9/1895 Russell ..... B67C 11/02 141/332
1,612,450 A * 12/1926 Leichtfuss ..... B01D 24/22 210/250
2,071,944 A * 2/1937 Hoffman ..... A47L 19/04 222/88
2,179,400 A * 11/1939 Casner ..... B67C 11/02 141/334
2,189,967 A * 2/1940 Sprouse ..... B67C 11/02 141/334
2,366,529 A * 1/1945 Hoff ..... B67C 11/00 141/106
2,883,057 A * 4/1959 Richards ..... B44D 3/10 210/476
3,643,704 A * 2/1972 Carr ..... B65B 3/06 141/106
3,712,652 A * 1/1973 Uilkema ..... A63C 11/221 403/108
4,114,660 A * 9/1978 Arruda ..... B67C 11/04 141/339
4,245,666 A * 1/1981 Norris ..... E04D 13/00 137/357

(Continued)

FOREIGN PATENT DOCUMENTS

CH 98277 3/1923
CN 201343441 11/2009

(Continued)

*Primary Examiner* — Timothy L Maust

(74) *Attorney, Agent, or Firm* — Weiss & Moy, P.C.; Jeffrey D. Moy

(57) ABSTRACT

A product transfer device has a funnel. A plurality of legs is coupled to a bottom area of the funnel. A plurality of stabilizers is attached to a top area of the funnel for holding a container within the funnel.

13 Claims, 9 Drawing Sheets

(56) References Cited

U.S. PATENT DOCUMENTS

| | | | | |
|---|---|---|---|---|
| 4,832,095 | A * | 5/1989 | Bonnell | B65D 71/502 141/106 |
| 5,389,253 | A * | 2/1995 | Cicconi | B01D 29/085 210/248 |
| 6,109,313 | A * | 8/2000 | Phelps | B67D 7/02 141/106 |
| 6,405,765 | B1 * | 6/2002 | Handrick | F16N 31/002 141/106 |
| 6,460,761 | B1 * | 10/2002 | Fraga | B65D 50/00 220/86.1 |
| 7,588,217 | B1 * | 9/2009 | Rooker | B65B 39/08 248/94 |
| 8,567,456 | B1 * | 10/2013 | Francis | B67C 11/02 141/332 |
| 8,672,197 | B2 * | 3/2014 | Piazza | B67D 3/0061 222/527 |
| 2012/0097809 | A1 | 4/2012 | Carlson | |
| 2013/0014859 | A1 | 1/2013 | Friedlich | |
| 2014/0041757 | A1 | 2/2014 | Kassouni | |
| 2016/0137475 | A1 * | 5/2016 | Friedlich | B67D 7/845 141/341 |

FOREIGN PATENT DOCUMENTS

| | | |
|---|---|---|
| CN | 204159355 | 2/2015 |
| GB | 810825 | 3/1959 |
| KR | 200468001 | 7/2013 |

* cited by examiner

FREESTANDING PRODUCT TRANSFER DEVICE

RELATED APPLICATIONS

This patent application is related to U.S. Provisional Application No. 62/827,592 filed Apr. 1, 2019, entitled "FREESTANDING PRODUCT TRANSFER DEVICE" in the name of Steven Michael Abbit, and which is incorporated herein by reference in its entirety. The present patent application claims the benefit under 35 U.S.C § 119(e).

TECHNICAL FIELD

The present invention relates generally to the technical field of funnels, and more particularly, to the technical field of freestanding devices which are aided by gravity to transfer material from one container to another container without continuous user involvement BACKGROUND Conventional funnels must be held or supported by the users' hand over a target container to ensure the funnel does not fall over, tip over or drip the contents of the funnel where it is not desired. This is because conventional funnels cannot stand on their own. Further, conventional funnels do not support the container being poured from, known as the source container. The source container must be held in an inverted position in the user's other hand to allow product to flow-out from it. As such, the use of both hands is typically required to effectively use a conventional funnel. Further, if the source container holds viscous liquids, it is not uncommon for the liquid to drain slowly, requiring the user to support the funnel and the inverted source container over the target container for extended periods of time to transfer all the contents from the source container over to the target container. Therefore, it is common for users to quit attempting to transfer the contents and discard the source container with product still remaining in the source container. It is also common for users to strongly shake the source container in a downward motion or tap it vigorously on a counter or their hand to force the remaining product to the opening, or neck, of the source container so the last of the product can be removed or drip out from the source container. Conventional funnels do not allow the user to transfer fluids without continuous interaction with the funnel unless the funnel or container(s) are precariously rested or balanced against another object, such as a wall. Further, it is not uncommon for children and adults with limited hand size, strength and/or coordination to have difficulty using conventional funnels without spilling contents Therefore, it would be desirable to provide a system and method that overcomes the above.

SUMMARY

In accordance with one embodiment, a product transfer device is disclosed. The product transfer device has a funnel. A plurality of legs is coupled to a bottom area of the funnel. A plurality of stabilizers is attached to a top area of the funnel for holding a container within the funnel.

In accordance with one embodiment, a product transfer device is disclosed. The product transfer device has a funnel. A plurality of adjustable length legs is coupled to a bottom area of the funnel. A plurality of leg receptacles is formed on the bottom area of the funnel, wherein each of the plurality of leg receptacles receives one of the plurality of legs. A locking hole is formed in each of the plurality of leg receptacles receiving a locking pin from a corresponding leg. A plurality of stabilizers is attached to a top area of the funnel for holding a container within the funnel. A plurality of stabilizer receptacles is formed on the top area of the funnel, wherein each of the plurality of stabilizer receptacles receiving one of the plurality of stabilizers.

BRIEF DESCRIPTION OF THE DRAWINGS

The present application is further detailed with respect to the following drawings. These figures are not intended to limit the scope of the present application but rather illustrate certain attributes thereof. The same reference numbers will be used throughout the drawings to refer to the same or like parts.

DESCRIPTION OF THE APPLICATION

Figure 1:
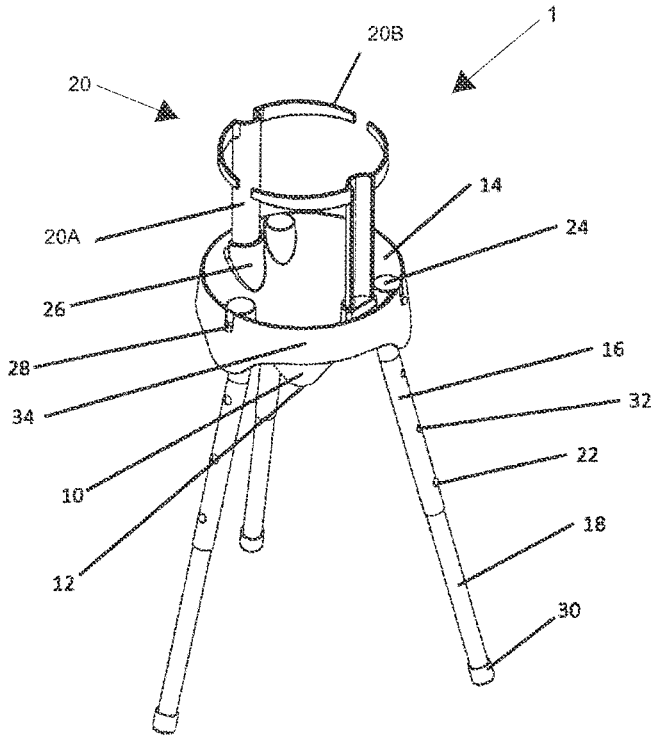
FIG. 1 is a perspective view of an exemplary assembled product transfer device in accordance with one aspect of the present application.
Figure 2:
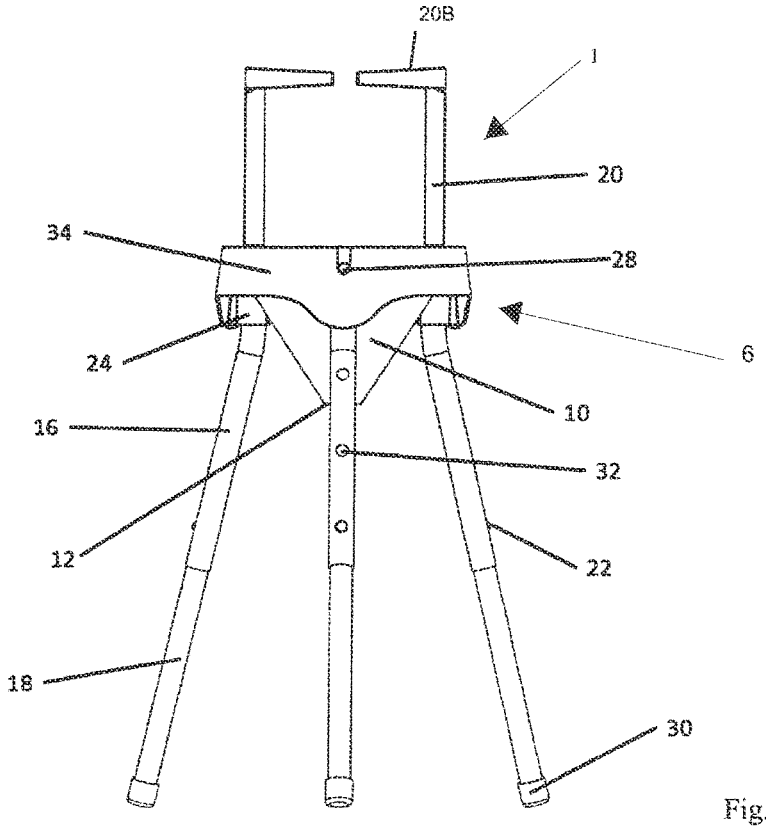
FIG. 2 is a side view of the exemplary assembled product transfer device of FIG. 1 with legs extended in accordance with one aspect of the present application.
Figure 3:
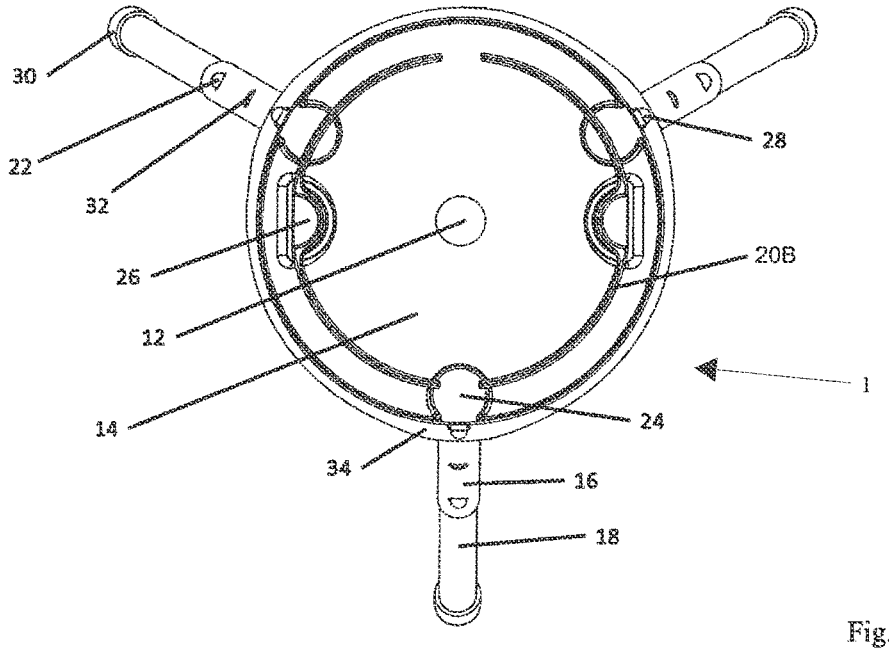
FIG. 3 is a top view of the exemplary assembled product transfer device of FIG. 1 in accordance with one aspect of the present application.
Figure 4:
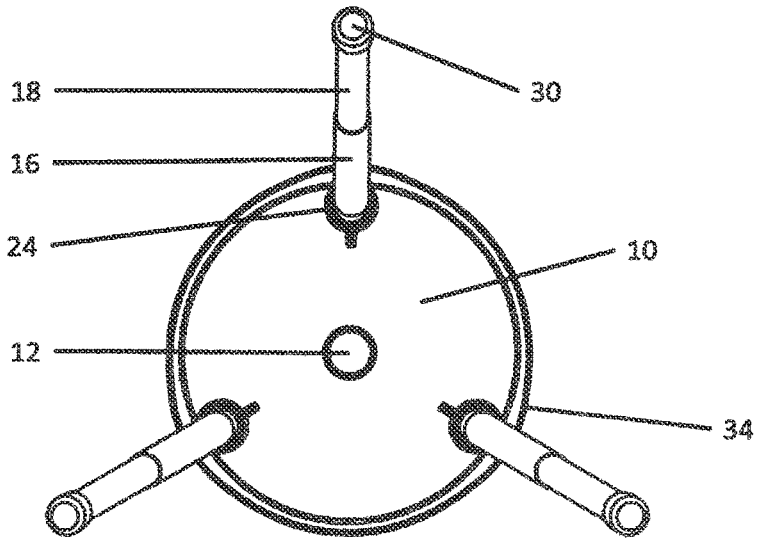
FIG. 4 is a bottom view of the exemplary assembled product transfer device of FIG. 1 in accordance with one aspect of the present application.

The description set forth below in connection with the appended drawings is intended as a description of presently preferred embodiments of the disclosure and is not intended to represent the only forms in which the present disclosure can be constructed and/or utilized. The description sets forth the functions and the sequence of steps for constructing and operating the disclosure in connection with the illustrated embodiments. It is to be understood, however, that the same or equivalent functions and sequences can be accomplished by different embodiments that are also intended to be encompassed within the spirit and scope of this disclosure.

Referring now to FIGS. 1-9, the freestanding product transfer device 1 may be disclosed. The freestanding product transfer device 1 may have a funnel 6 held in a substantially level position elevated above a surface by a plurality of upright, height-adjustable legs 8 and includes at least one finger/stabilizer 20 to support an inverted source container placed within and/or between the fingers/stabilizers 20. The freestanding product transfer device 1 may allow a source container to be positioned upside down within the funnel 6. The fingers/stabilizers 20 may hold the source container upside down so that any contents within the source container may flow out of the source container and into the funnel 6. A target container may be positioned under the funnel 6 so that the contents from the source container may flow into the target container.

The funnel 6 may be any type of funnel. In the present embodiment, the funnel 6 may have an outside funnel body 10, a funnel drain hole 12, inside funnel body 14 and a funnel collar 34. The funnel 6 portion of the present embodiment, may include a plurality of leg-to-funnel receptacles 24. Each leg-to-funnel receptacle 24 may be used to attach an individual leg 8 to the funnel 6 from the underside of the funnel 6. The funnel 6 of the present embodiment may include two or more finger/stabilizer receptacles 26 which may be formed on the funnel inside body 14. Each of the finger/stabilizer receptacles 26 may be used to hold one of the fingers/stabilizers 20. The funnel 6 of the present embodiment may include a collar 34. The collar 34 may extend around a perimeter of the funnel 6. The collar 34 may extend outward and downward around the entire perimeter of the funnel 6. In accordance with one embodiment, the collar 34 may be an "L" ring. The collar 34 may be used to allow a user to hold the funnel 6 by wrapping the user's fingers underneath and between the collar 34 and the funnel outside body 10 for a stronger, more secure grip over that of a traditional funnel with no collar. The collar 34 may also allow a flat, nearly vertical surface for advertising the name of the seller or for private brand advertising. The funnel 6 of the current embodiment may include a leg-to-funnel hole 29. The leg-to-funnel hole 29 may be used to allow the leg 8 to lock into a corresponding leg receptacle 24.

Each leg 8 may have a rubber-like foot 30 attached to a bottom area of each leg 8. The foot 30 may be used to reduce slippage of the leg 8 on a surface when force is applied laterally or downwardly to the freestanding product transfer device 1. In the FIGS., each of the three height adjustable legs 8 may be shown to have two sections which may be adjusted to their tallest/longest position. However, this is shown as an example and the three height adjustable legs 8 may have more than two members and may be adjusted to a plurality of different heights. Further, in accordance with one embodiment, the legs 8 may be a single non-adjustable leg 8.

In the present embodiment, the fingers/stabilizers 20 extend upwardly from finger/stabilizer receptacles 26 located on the inside of funnel body 14. The fingers/stabilizers 20 may extend above the top of the funnel 6 to provide lateral support to a source container placed inverted between the fingers/stabilizers 20 allowing the source container to be held in a mostly inverted and vertical position. The fingers/stabilizers 20 are sufficiently tall to laterally support inverted source containers of varying heights. In the present embodiment, the fingers/stabilizers 20 may have a leg member 20A. Finger members 20B may be formed on one end of the leg member 20A. In the present embodiment, the finger member 20B may be a semi-circular in shape.

Each leg 8 may slide into a corresponding leg receptacle 24 on the underside of the funnel 6. Each leg 8 may lock into the corresponding leg receptacle 24. In accordance with one embodiment, each leg 8 may lock into the corresponding leg receptacle 24 using a leg-to-funnel spring button 28 formed within the leg 8. The leg-to-funnel spring button 28 may protrude through a leg-to-funnel spring button hole 29 in the funnel 6. Each of the leg receptacles 24 may be located at approximately equal distances around the underside of the funnel 6. Each leg receptacle 24 may protrude into the inner funnel body 14.

Figure 5:
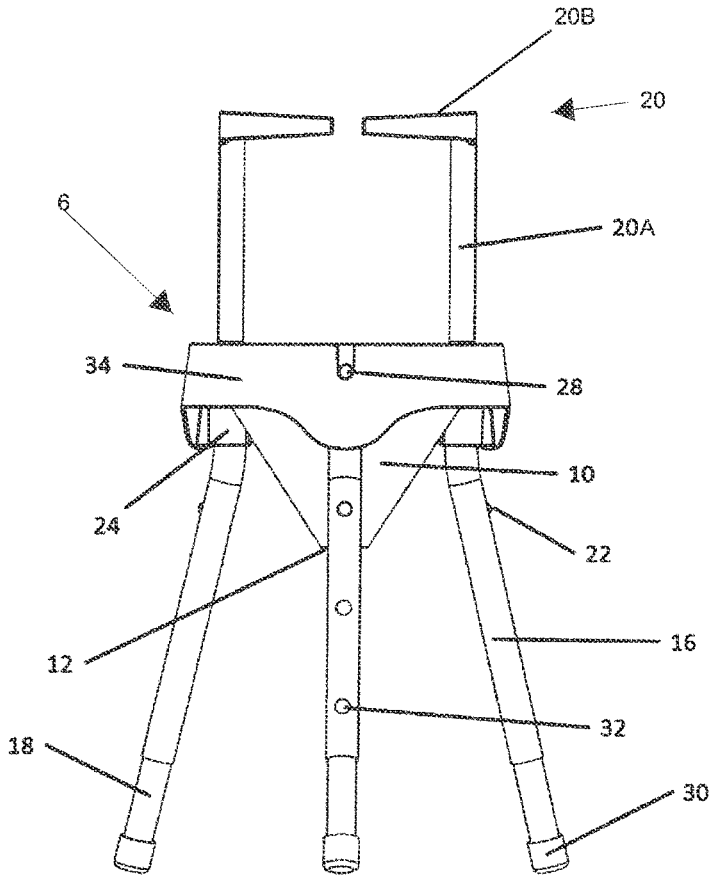
FIG. 5 is a side view of the exemplary assembled product transfer device of FIG. 1 with legs un-extended in accordance with one aspect of the present application.

Each leg 8 may be independently height/length adjusted. Each leg 8 may have one or more leg extension spring button 22 on the leg 8. To adjust a height of one of the legs 8, one may depress the spring button 22 on the leg 8, slide the lower, inner leg 18 down and allow the spring button 22 to snap into a height adjustment hole 32 on the outer leg 16. To un-extend the leg, the process is reversed by depressing the leg extension spring button 22 while simultaneously sliding the lower, inner leg 18 up into the outer leg 16 allowing the spring button 22 to snap into a height adjustment hole 32. The legs 8 may be adjustable in height so that the funnel 6 is positioned above target containers without user intervention. While FIGS. 1, 2, 8 and 9 show the legs 8 fully extended, the legs 8 may be retracted to an un-extended position as shown in FIG. 5.

The construction of the funnel 6, legs 8 and fingers/stabilizers 20 may be sufficiently strong and rigid enough to hold the weight of a large source container and its contents at the desired height. The legs 8, funnel 6 and fingers/stabilizers 20 may be made of metal or of any other sufficiently rigid and strong material such as wood, high-strength plastic and the like. Further, the various components of current invention can be made of different materials.

Figure 6:
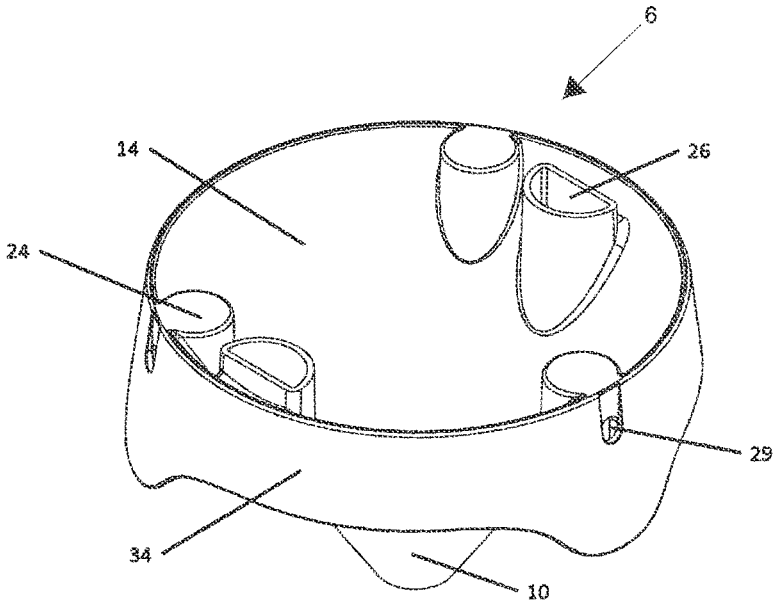
FIG. 6 is a perspective view of the exemplary funnel portion of the assembled product transfer device of FIG. 1 in accordance with one aspect of the present application.

As shown in FIG. 6, the funnel 6 portion of the present embodiment may be seen in further detail. The leg-to-funnel spring button hole 29 may be seen in this view as the leg 8 has been removed. The view may also show the finger/stabilizer receptacle 26 with no finger/stabilizer 20 inserted thereto. This view may show the funnel 6 in a traditional configuration with no legs 8 and no fingers/stabilizers 20 showing that the funnel 6 portion of the current invention can be used as a traditional funnel. This view may also show the funnel collar 34 under which the user can secure their fingers to securely hold the funnel 6.

Figure 7:
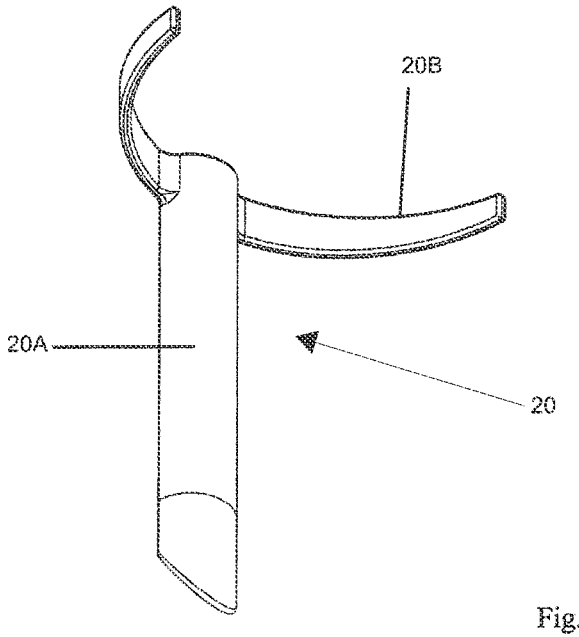
FIG. 7 is a perspective view of the exemplary fingers/stabilizers of the assembled product transfer device of FIG. 1 in accordance with one aspect of the present application.

As may be seen in FIG. 7, the fingers/stabilizers 20 may be seen in further detail. In the present embodiment, the fingers/stabilizers 20 may have a leg member 20A. Finger members 20B may be formed on one end of the leg member 20A. In the present embodiment, the finger member 20B may be a semi-circular in shape. A first end of the leg member 20A may be inserted into the finger/stabilizer receptacle 26 as shown in previous FIGS. The finger member 20B may be formed on a second end of the leg member 20A opposite of the first end. The finger member 20B may protrude horizontally and curve inwardly allowing it to laterally support an inverted source container. The construction details of the finger/stabilizer 20 may be such that they are sufficiently flexible enough to bend laterally to allow for a slightly larger inverted source container than the fingers/stabilizers 20 could hold without flexing.

Figure 8:
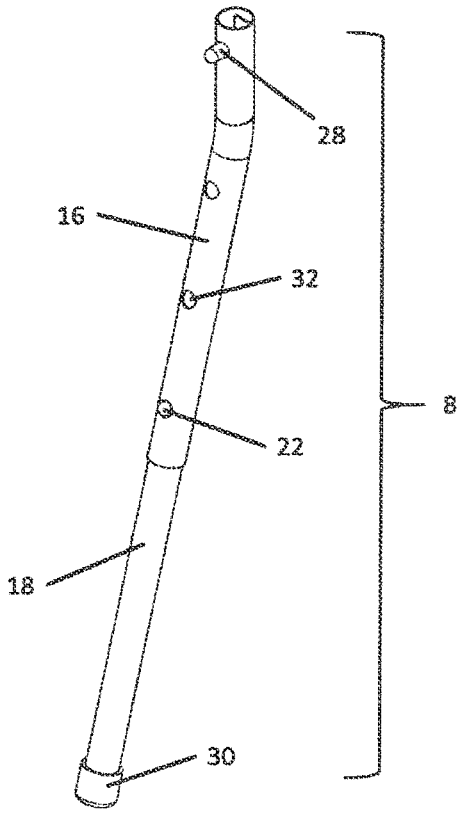
FIG. 8 is a perspective view of the exemplary adjustable legs portion of the assembled product transfer device of FIG. 1 in accordance with one aspect of the present application the current invention.

As may be seen in FIG. 8, an individual leg 8 may be seen in further detail. The top of the outer-leg 16 may be inserted into a corresponding leg receptacle 24 so that a leg-to-funnel spring button 28 which protrudes through a hole in the outer-leg 16 and through the leg receptacle 24. This leg-to-funnel spring button 28 holds the leg securely into the funnel 6 as shown in previous FIGS. The outer-leg 16 may also contain a plurality of leg length adjustment holes 32. The leg length adjustment holes 32 may allow the inner leg 18 with its leg extension spring button 22 to lock the leg 8 into a plurality of different heights, therefore allowing the funnel 6 to be held at different heights above a target container. The rubber foot 30 may be attached to the bottom of the inner leg 18, which is at the bottom of the leg 8 when it is fully assembled.

Figure 9:
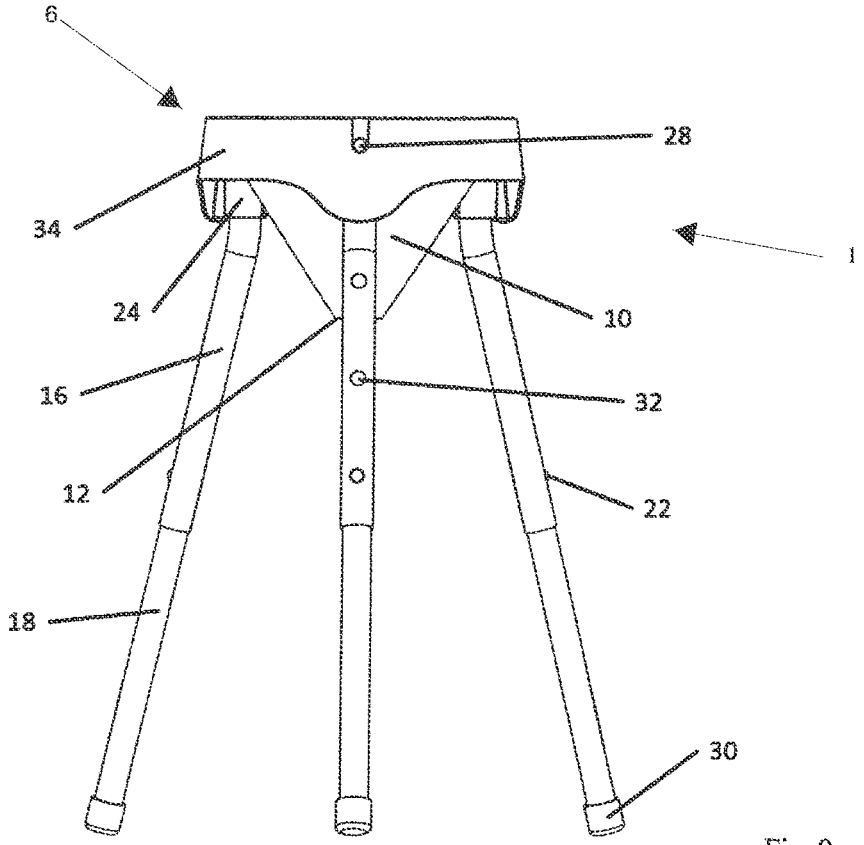
FIG. 9 is a side view of the exemplary product transfer device of FIG. 1 without fingers/stabilizers in accordance with one aspect of the present application of the current invention.

As may be seen in FIG. 9, the finger/stabilizer 20 may be removed. This configuration can be used when source containers do not require fingers/stabilizers 20. For example, the source container may be held and balanced around the outer perimeter of the funnel 6.

Figure 10:
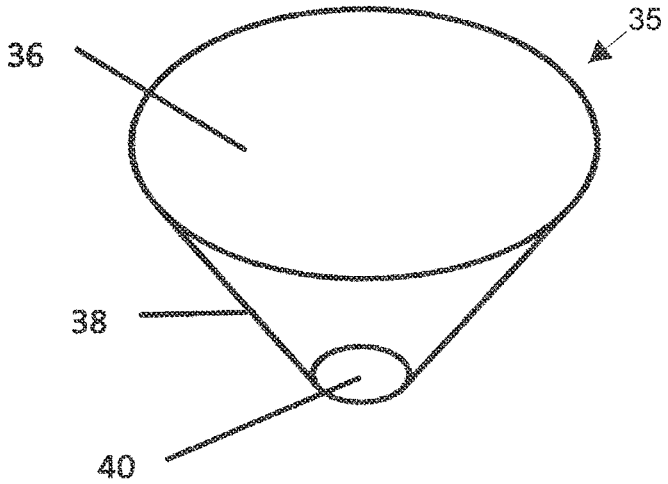
FIG. 10 is a perspective view of a disposable paper product transfer device liner to be used with the assembled product transfer device of FIG. 1 in accordance with one aspect of the present application.
Figure 11:
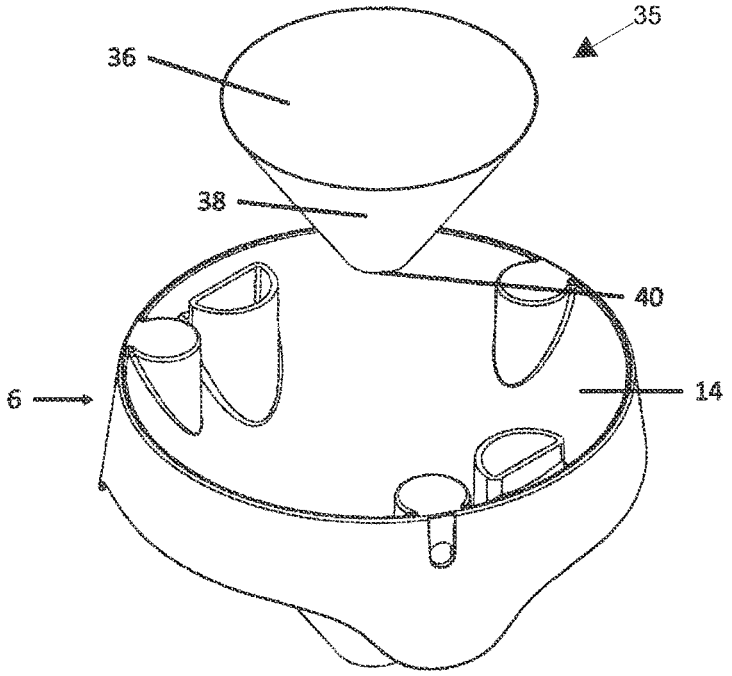
FIG. 11 is a perspective view of the exemplary disposable paper product transfer device liner inserting into the funnel portion of the assembled product transfer device of FIG. 1 in accordance with one aspect of the present application the current invention.

Referring now to FIGS. 10 and 11, there is shown a disposable paper liner 35 may be shown. The disposable paper liner 35 may be placed, if the user so desires, on the inside-of-funnel-body 14 as shown in FIG. 11. The disposable paper liner 35 may be comprised of an inside-of-paper-funnel-liner 36, and outside-of-paper-funnel-liner 38 and a hole-in-paper-funnel-liner 40 for product from the source container to drain through. The disposable paper liner 35 may be used to keep the funnel 6 clean. More specifically, the disposable paper liner 35 may be used to keep the inside funnel body 14 clean so that the funnel 6 may not need to be washed after every usage.

Figure 12:
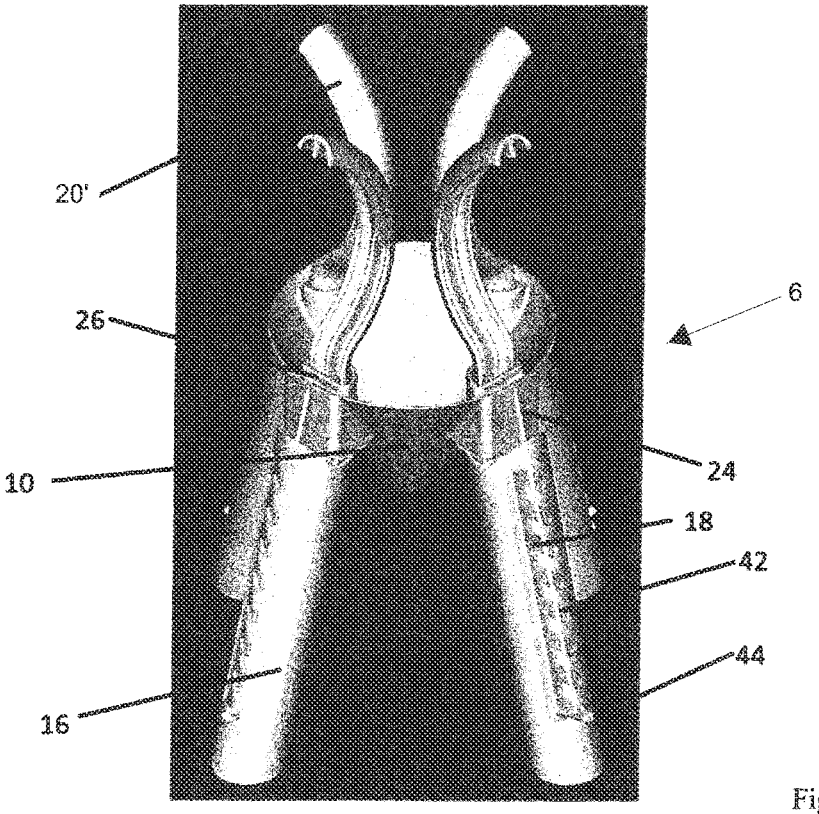
FIG. 12 is a perspective view of an exemplary assembled product transfer device in accordance with one aspect of the present application the current invention.

Referring to FIG. 12, another embodiment of the fingers/stabilizers 20' may be seen. In this embodiment, the fingers/stabilizers 20' extend upwardly from finger/stabilizer receptacles 26 located on the inside of funnel body 14. The fingers/stabilizers 20' may extend up and inwards towards the inside of funnel body 14 and then up and away from the inside of funnel body 14 forming a semi-circular configuration. The construction details of the finger/stabilizer 20' may be such that they are sufficiently flexible enough to bend laterally to allow for a slightly larger inverted source container than the fingers/stabilizers 20' could hold without flexing.

Figure 13:
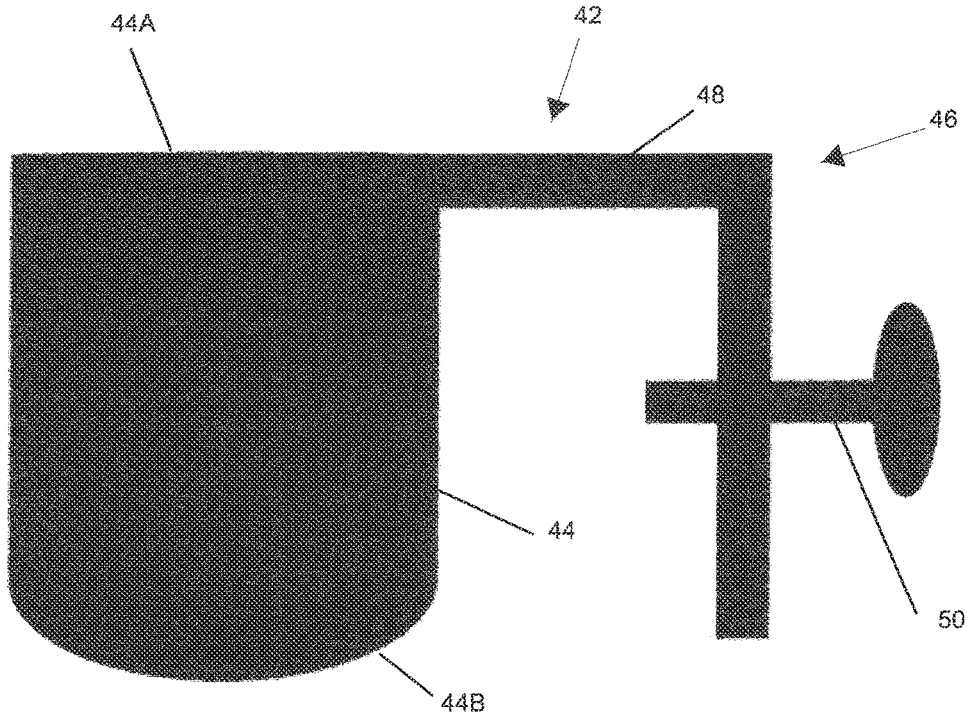
FIG. 13 is a side view of an exemplary bracket to be used with the assembled product transfer device of FIG. 1 in accordance with one aspect of the present application the current invention.
Figure 14:
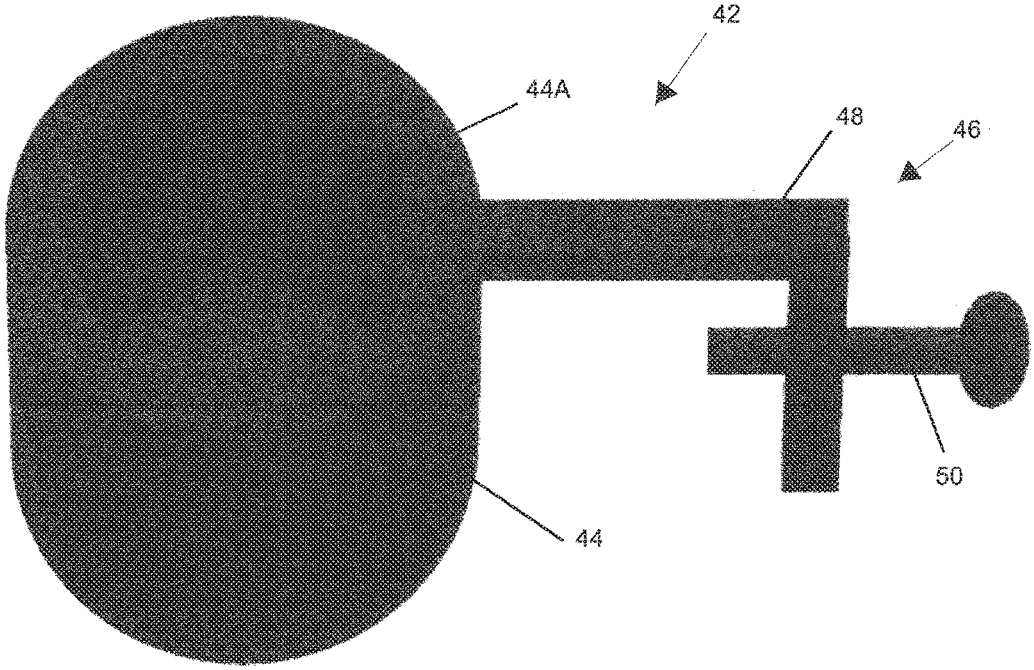
FIG. 14 a perspective view of the exemplary bracket of FIG. 13 to be used with the assembled product transfer device of FIG. 1 in accordance with one aspect of the present application the current invention.
Figure 15:
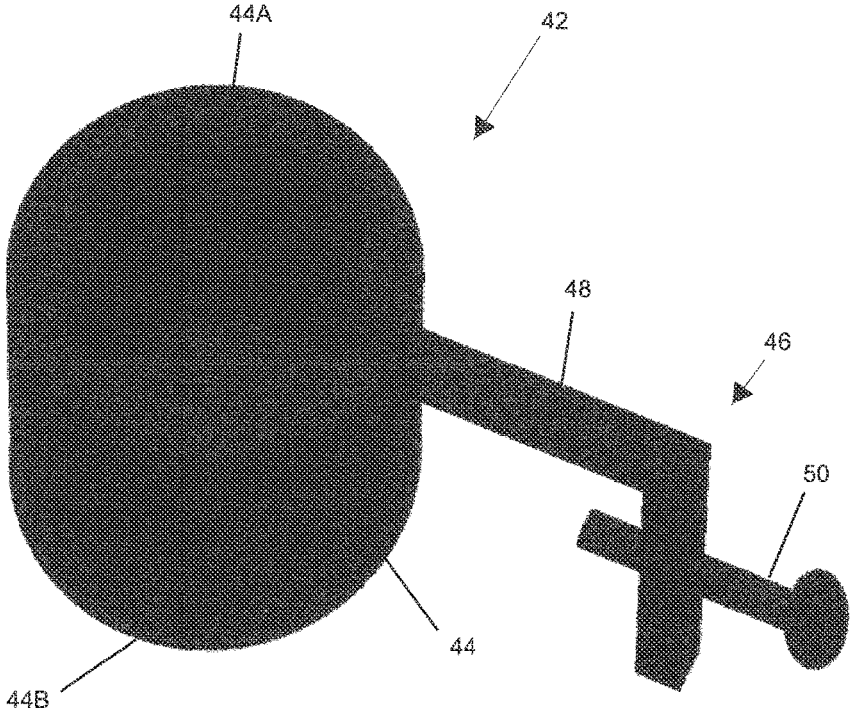
FIG. 15 another perspective view of the exemplary bracket of FIG. 13 to be used with the assembled product transfer device of FIG. 1 in accordance with one aspect of the present application the current invention.

Referring now to FIGS. 13-15, an attachment 42 may be shown that may be used with the freestanding product transfer device 1. The attachment 42 may be used when the target container is a large container such as a five (5) gallon paint bucket or similar large containers. The attachment 42 may have a base 44. In the present embodiment, the base 44 is cylindrical in shape. However, this is shown as an example and the base 44 may be formed in other geometrical configurations. The base 44 may be sized so that at least one of the legs 8 may be placed and held within the base 44 thereby holding the freestanding product transfer device 1 over the target container. The base 44 may be hollow and may have an open top 44A and an open bottom 44B. This may allow the one or more legs 8 to be more securely held within the base. With the legs 8 placed within the base 44, the freestanding product transfer device 1 may be positioned so that the funnel drain hole 12 may be aligned with the opening of the target container.

A securing mechanism 46 may be attached to the base 44. The securing mechanism may allow one to attach the base 44 to the target container. In accordance with one embodiment, the securing mechanism 46 may be a bar 48. The bar 48 may be an "L" shape bar where the bottom of the "L" shape bar may be approximately parallel to the base 44. A locking device 50 may be formed on the bar 48. The locking device 50 may be used to secure the attachment 42 to the target container. In accordance with one embodiment the locking device 50 may be a lock screw attached to the bottom of the "L" shape bar.

Figure 16:
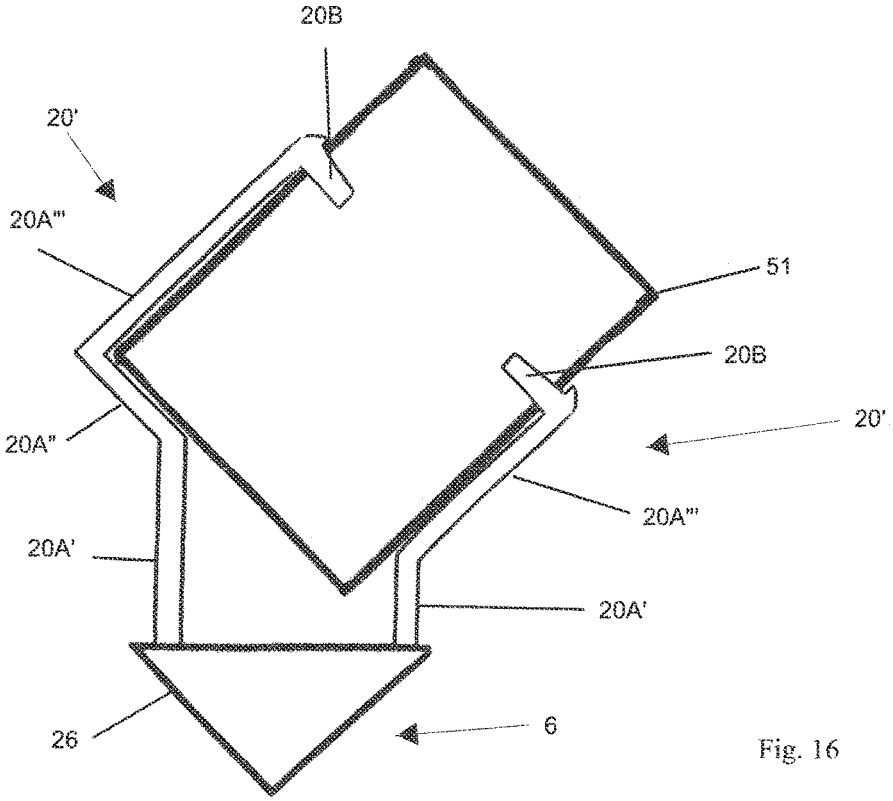
FIG. 16 a perspective view of exemplary fingers/stabilizers to be used with the assembled product transfer device of FIG. 1 in accordance with one aspect of the present application the current invention.

Referring to FIG. 16, another embodiment of the fingers/stabilizers 20' may be seen. In the present embodiment, the fingers/stabilizers 20' may be formed to hold a larger source container 51, such as a gallon paint can, at an angle to allow the contents of the larger source container to drain into the freestanding product transfer device 1.

In the present embodiment, there may be a pair of fingers/stabilizers 20'. Each of the pair of fingers/stabilizers 20' may have a leg member 20A'. The leg member 20A' may extend straight up when the leg member 20A' is inserted into a respective finger/stabilizer receptacle 26. However, a first of the pair of fingers/stabilizers 20' may have a leg member 20A' that is longer than the leg member 20A' of the second of the pair of fingers/stabilizers 20'. In the embodiment shown in FIG. 16, the first of the pair of fingers/stabilizers 20' may have a leg member 20A' that is approximately twice as long as the leg member 20A' of the second of the pair of fingers/stabilizers 20'. The first of the pair of fingers/stabilizers 20' may have a second leg member 20A". The second leg member 20A" may extend up and away from the funnel 6.

Both the of the pair of fingers/stabilizers 20' may have a holding leg 20A'". The holding leg 20A'" may extend up and inward from the second leg member 20A" on the first of the pair of fingers/stabilizers 20' and up and outward from the leg member 20A' of the second of the pair of fingers/stabilizers 20'. The holding leg 20A'" for each of the pair of fingers/stabilizers 20' may be parallel to each other. Finger members 20B may be formed on each holding leg 20A'".

Figure 17:
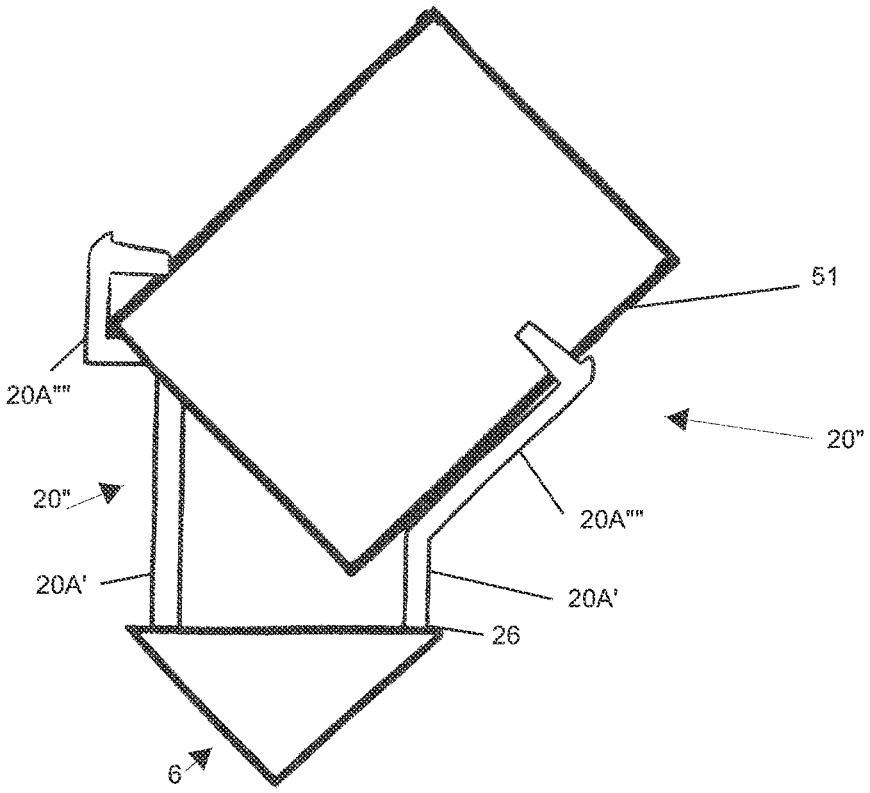
FIG. 17 a perspective view of exemplary fingers/stabilizers to be used with the assembled product transfer device of FIG. 1 in accordance with one aspect of the present application the current invention.

Referring to FIG. 17, another embodiment of the fingers/stabilizers 20" may be seen. In the present embodiment, the fingers/stabilizers 20" may be formed to hold a larger source container 51, such as a gallon paint can, at an angle to allow the contents of the larger source container to drain into the freestanding product transfer device 1.

In the present embodiment, there may be a pair of fingers/stabilizers 20". Each of the pair of fingers/stabilizers 20" may have a leg member 20A'. The leg member 20A' may extend straight up when the leg member 20A' is inserted into a respective finger/stabilizer receptacle 26. However, a first of the pair of fingers/stabilizers 20' may have a leg member 20A' that is longer than the leg member 20A' of the second of the pair of fingers/stabilizers 20'. In the embodiment shown in FIG. 17, the first of the pair of fingers/stabilizers

20' may have a leg member 20A' that is at least twice as long as the leg member 20A' of the second of the pair of fingers/stabilizers 20'.

The first of the pair of fingers/stabilizers 20" may have a holding leg 20A"". The holding leg 20A"" may be an "L" shaped leg. The second of the pair of fingers/stabilizers 20" may have a holding leg 20A"". The holding leg 20A"" may extend up and away from the funnel 6. Finger members 20B may be formed on each holding leg 20A"".

The foregoing description is illustrative of particular embodiments of the application, but is not meant to be a limitation upon the practice thereof. The following claims, including all equivalents thereof, are intended to define the scope of the application.

What is claimed is:

1. A product transfer device comprising:

a funnel;

a plurality of legs coupled to a bottom area of the funnel; and a plurality of stabilizers attached to a top area of the funnel for holding a container within the funnel, wherein the plurality of stabilizers comprises:

a first stabilizer having a first stabilizer first leg member extending straight up from the funnel, a first stabilizer second leg member extending up and away from the funnel and a first stabilizer holding leg extending up and inward towards the funnel;

a second stabilizer having a second stabilizer first leg member extending straight up from the funnel and a second stabilizer holding leg extending up and away from the funnel, the first stabilizer holding leg and the second stabilizer holding leg approximately parallel; and fingers attached to the first stabilizer holding leg and the second stabilizer holding leg.

2. The device of claim 1, comprising a plurality of leg receptacles formed on the bottom area of the funnel.

3. The device of claim 2, comprising a locking hole formed in each of the plurality of leg receptacles.

4. The device of claim 1, comprising a plurality of stabilizer receptacles formed on the top area of the funnel.

5. The device of claim 1, wherein the finger members are semi-circular in shape.

6. The device of claim 1, wherein each of the plurality of legs is adjustable in length.

7. The device of claim 1, wherein each of the plurality of legs is a telescopic leg adjustable in length.

8. The device of claim 1, comprising an attachment device for securing a target to the device.

9. The device of claim 8, wherein the attachment device comprises:

a hollow base;

a bar coupled to the hollow base; and a securing mechanism coupled to the bar.

10. The device of claim 1, wherein the plurality of stabilizers holds a source container at an angle.

11. The device of claim 1, comprising a liner placed within the funnel.

12. The device of claim 1, comprising a collar formed around a perimeter of the funnel.

13. The device of claim 1, wherein the collar is an "L" shaped ring.

* * * * *